US005464510A

United States Patent [19]

Oehr et al.

[11] Patent Number: 5,464,510

[45] Date of Patent: Nov. 7, 1995

[54] METHOD FOR REMOVAL OF CERTAIN OXIDE FILMS FROM METAL SURFACES

[75] Inventors: Klaus H. Oehr, Surrey; Richard R. Timewell, Vancouver; Harvey Donahue; Brenda Hoy, both of New Westminster; Ronald Kim; Reinhold C. Roth, both of Vancouver, all of Canada

[73] Assignee: Dynamotive Corporation, Vancouver, Canada

[21] Appl. No.: 266,673

[22] Filed: Jun. 28, 1994

Related U.S. Application Data

[63] Continuation-in-part of Ser. No. 95,689, Jul. 21, 1993, Pat. No. 5,407,544.

[51] Int. Cl.[6] ..... C25F 1/00

[52] U.S. Cl. ..... 204/141.5; 204/144.5; 204/145 R; 204/146

[58] Field of Search ..... 204/145 R, 146, 204/141.5, 144.5

[56] References Cited

U.S. PATENT DOCUMENTS 3,525,243 8/1970 Chrablow ..... 72/39

4,406,761 9/1983 Shimogori et al. ..... 204/144.5

4,711,707 12/1987 Kikuchi et al. ..... 204/145 R 4,795,537 1/1989 Timewell ..... 204/129

*Primary Examiner*—John Niebling

*Assistant Examiner*—Arun S. Phasge

*Attorney, Agent, or Firm*—Jensen & Puntigam

[57] ABSTRACT

A manufactured metal member, such as a wire, having a magnetite oxide film thereon, is subjected to mechanical stress to produce cracking of the magnetite film approximately to the surface of the metal member. The metal member is then moved through an electrolysis cell bath in which the metal member forms the anode thereof, and vertically positioned steel bars form the cathode. A pulsating DC current is applied to the anode and the cathode. The current flows to the surface of the metal member via the cracks in the oxide, maintaining the metal member anode in a state of depassivation and loosening the bond between the oxide film and the metal member. The loosened magnetite is then readily cleaned off the metal member. A thermal stressing step may also be used prior to the mechanical stressing.

29 Claims, 3 Drawing Sheets

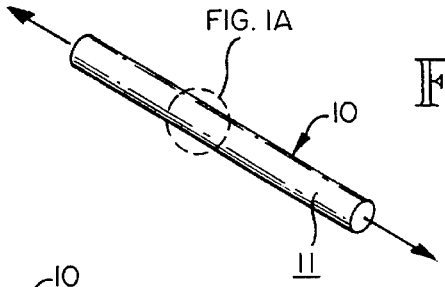
FIG. 1
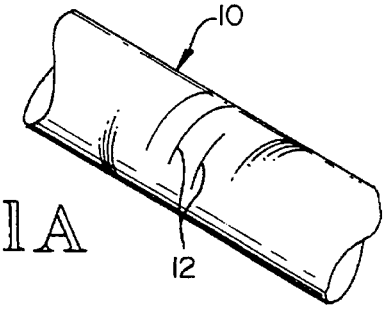
FIG. 1A
FIG. 2
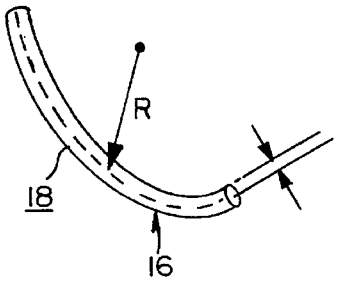
FIG. 4
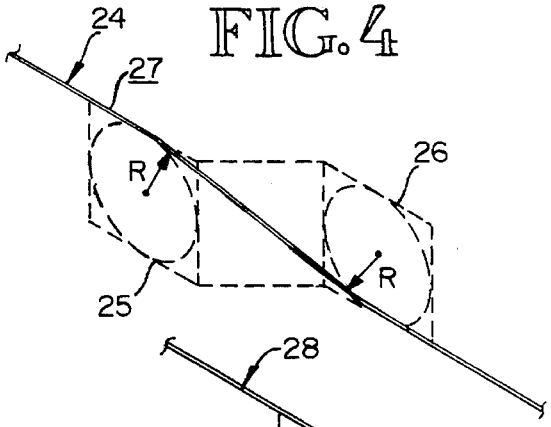
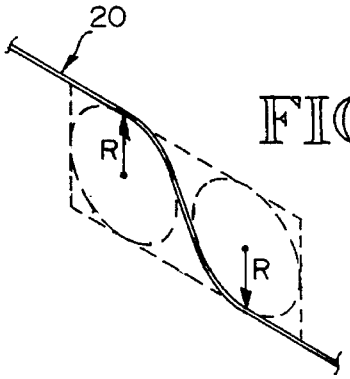
FIG. 3
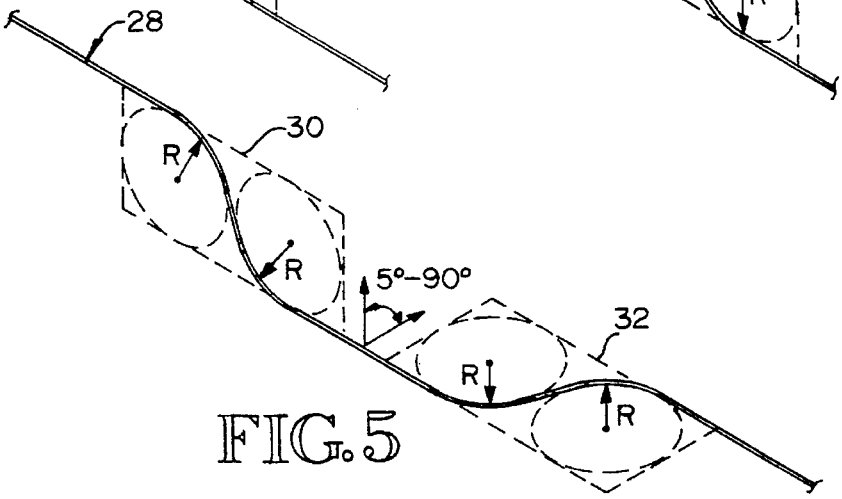
FIG. 5

METHOD FOR REMOVAL OF CERTAIN OXIDE FILMS FROM METAL SURFACES

This application is a continuation-in-part application of U.S. Ser. No. 08/095,689 filed Jul. 21, 1993, now U.S. Pat. No. 5,407,544.

TECHNICAL FIELD

The present invention relates generally to the art of removing certain oxide films, such as magnetite, from metal surfaces and more particularly concerns such a method which does not use an acid bath.

BACKGROUND OF THE INVENTION

In the manufacture of raw metal goods, such as steel wire, steel bars, etc., an oxide film forms on the end product due to the reaction of oxygen with the hot iron after annealing or other heat treatment and prior to quenching. In one significant example, magnetite ($Fe_3O_4$)—containing films occur on the surfaces of iron-containing steel goods. The magnetite film is produced at elevated temperatures during extrusion when the metal goods come into physical contact with an oxygen-containing gas, such as air. An elevated temperature is typically required in the case of steel wire, for example, to reduce the stress produced by the extrusion process. This particular oxide, i.e. magnetite, must be removed from the steel wire prior to any subsequent processing such as galvanizing and/or electroplating. The subsequent processing will not be successful unless the underlying wire metal surface is free from magnetite. Hence, the efficient, complete removal of magnetite from the underlying metal product is quite important and highly desirable.

A traditional method of removing such oxide films is to immerse the oxide-coated metal product in an acid bath, referred to generally as acid pickling. Hydrochloric and sulfuric acid are two examples of appropriate acid mediums. Such acids are capable of dissolving ferric oxide ($Fe_2O_3$), magnetite ($Fe_3O_4$) and ferrous oxide (FeO). The acid bath is effective in removing the oxide, producing water and various iron salts in a well known chemical reaction. Following removal of the oxide, the iron in an underlying steel product will continue to dissolve, with hydrogen gas being produced as well as dissolved iron salts.

Although acid pickling produces a rapid removal of the oxide, it does have several disadvantages, including possible hydrogen embrittlement of the underlying metal product, due to the absorption of hydrogen by the metal product, resulting in blisters, cracks and flakes in the metal product. Further, the chemicals used in the pickling process are typically quite corrosive and are usually quite expensive, adding to the cost of the process. Toxic effluents also are produced by the process and they must be treated. Lastly, the concentration of the acid pickling bath continuously changes, due to the change in the amount of dissolved salts produced during the process and in solution in the acid bath.

There have been attempts to remove oxides with methods other than pickling. One such attempt is described in U.S. Pat. No. 4,795,537 to Timewell. While the '537 process is successful in removing many oxides, there are some oxides, such as magnetite, which are resistant to the Timewell pulsating DC electrolysis system as described.

Hence, there is a need for a process to efficiently remove magnetite and similar oxide coatings from metal products, such as wire, metal rods, etc. following the manufacture (extrusion) thereof, in order to permit the use of additional processing such as, for instance, electroplating.

DISCLOSURE OF THE INVENTION

Accordingly, the invention includes a method for removal of oxide films, such as magnetite, from a metal member, and the resulting product, comprising the steps of: applying stress to the metal member so as to rupture the oxide film thereon approximately to the surface of the metal member; moving the metal member through an electrolysis cell bath having two spaced electrodes wherein the metal member itself forms one electrode; and applying a pulsating DC signal to the one electrode and to the other electrode, wherein the oxide on the metal member is sufficiently ruptured that the pulsating DC signal flows through the rupture areas to the metal member, maintaining the metal member electrode in a state of depassivation such that no oxygen is produced therefrom, and loosening the oxide film from the metal member, so that the oxide film can be readily removed from the metal member.

BRIEF DESCRIPTION OF THE DRAWINGS

FIGS. 1 through 5 show various techniques for cracking the surface of a magnetite film, the first step in the process of the present invention.

BEST MODE FOR CARRYING OUT THE INVENTION

Figure 6:
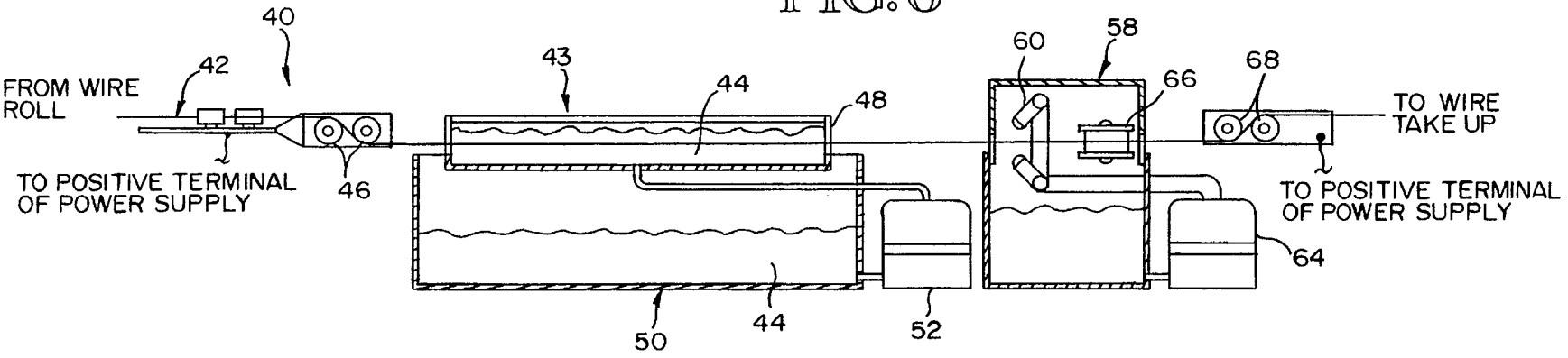
FIGS. 6 and 7 show the overall process of the present invention.

The present invention involves the removal of a magnetite film or other similar oxide from a metal base product such as, for instance, a wire, bar, rod or metal sheet, etc. This description concerns in particular the oxide known as magnetite ($Fe_3O_4$), but other oxide films which are brittle (subject to cracking) and which are less electrically conductive than the metal substrate may also be removed by the method of the present invention. A magnetite film is produced, as described above, when the surface of iron-containing metals, such as steel, come into contact with an oxygen-containing gas, such as air, at elevated temperatures, such as what might be expected during extrusion of steel wire, in which high temperatures are used to reduce the extrusion stress. As indicated above, it is important that the magnetite film be removed if the steel wire or other product is to undergo subsequent processing, such as galvanizing or electroplating.

In the method of the present invention, the magnetite film is first partially cracked or ruptured in order to provide access to the metal substrate therebeneath. FIGS. 1 through 5 indicate several different techniques to produce adequate rupturing, although other methods can be used as well. In the first technique, shown in FIG. 1, tensile stress is applied axially to an extruded magnetite-coated wire or rod 10. The term wire is used herein to cover a rod as well, since a rod is generally regarded as a thick wire. This produces strain on the outer surface 11 of the magnetite film, resulting in the enlargement of existing minor cracks and surface imperfections in the magnetite film such that they propagate around the circumference of the wire, as indicated by the numeral 12 in FIG. 1A. Such surface cracking has been shown to occur with a tensile strain in the range of $0.8–3.2\times10^{-3}$, as discussed in an article by P. L. Harrison titled "Tensile Fracture of Magnetite Films" in *Corrosion Science*, 1967, Vol. 7, pp. 789–794.

A second cracking method is shown in FIG. 2. In this method, a wire 16 is bent or curved to induce tensile stress on the outer surface 18 of the wire. For an oxide thickness of 2 micrometers, the required strain to produce appropriate cracking should typically be the same as mentioned above with respect to FIG. 1.

FIG. 3 shows a variation of the method of FIG. 2, in which a wire 20 is bent first in one direction then bent in a reverse, i.e. 180° removed, direction in the same plane, typically by the use of spaced pulleys (shown in plan form), in order to stress both sides of the wire, and thereby induce substantial cracking in the surface of the magnetite film.

FIG. 4 shows a variation of the method of FIG. 3, in which a wire 24 is bent sequentially in two directions, but in slightly offset parallel planes 25, 26, again by the use of pulleys. This produces the required cracking or rupturing in the magnetite surface 27. FIG. 5 shows another variation of the method of FIG. 3, in which a wire 28 is first bent in two directions in a single plane 30, and then bent again in two directions in a plane 32 which is rotated between 5° and 90° away from the first plane. The method of FIG. 5 can be used to supplement the previously described methods of FIGS. 1–4 to produce cracking over the entire surface of a wire.

In addition to the above specific methods, other methods for producing surface cracking of the oxide film are possible, including the use of ultrasonic vibration, particularly when the product is submerged, particle impact techniques such as sand blasting, and wire brushes. The particular cracking technique used will vary with configuration of the raw metal product, i.e. whether it is a wire/rod, bar, sheet or some other configuration.

All of the above are designed to produce a consistent cracking or rupturing of the oxide film along the length of the metal substrate, following any "front-end" processing steps such as annealing, etc. The cracks must be more than surface cracks, i.e. they must extend down to the surface of the metal substrate.

Figure 7:
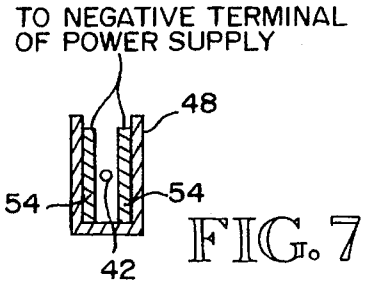

The entire process is shown in FIGS. 6 and 7. After undergoing the rupturing/cracking step, as shown generally at 40 for a 2 plane bend (FIG. 5), the magnetite-coated wire 42 moves through an electrolysis cell bath, shown generally at 43, in which it is the anode portion thereof. The electrolysis cell bath is shown and described in the '537 patent to Timewell, which is hereby incorporated by reference.

Typically, the electrolysis cell medium 44 will be a sodium chloride solution, at room temperature. The magnetite-coated wire 42 is the anode and the positive terminal of a power supply (not shown) is connected to the front pulleys 46, which contact the wire 42.

One or more steel bars 54 (FIG. 7), usually vertically positioned, L-shaped or U-shaped, etc. form the cathode, and are typically positioned fairly close to the wire anode, approximately 0.5 inches at the closest point. The wire 42 is continuously moved through an elongated, narrow tray 48 containing the sodium chloride solution. The solution 44 will overflow the ends of tray 48 into a recirculating tank 50, where it is pumped back into tray 48 by pump 52. The negative terminal of the power supply is connected to the steel bar cathode 54.

The signal from the power supply is a pulsating DC signal. The current bypasses the magnetic oxide layer by means of the cracks or ruptures therein to the metal substrate therebeneath, instead of flowing through the magnetite film. This results in the anode surface, i.e. the surface of the metal wire substrate, being maintained essentially in a state of depassivation, such that no oxygen is produced off the substrate. In a state of depassivation, as described in the '573 patent, the anode dissolves at a fairly rapid rate, without producing any oxygen. This results in a significant reduction in the strength of the mechanical bond between the magnetite film and the metal substrate, thereby loosening the magnetite film from the surface of the substrate.

At this point, some of the oxide film typically has already come off. The remainder (magnetite smut) may be readily removed by various techniques. Referring to FIG. 6, the smutted wire is fed through a rinse tank 58, which includes several spray heads 60, which direct a stream of water at the treated wire, either at conventional pressure of 40 psi or greater. Alternatively, the wire may be submerged with ultrasonic transducers which may be, but necessarily, tuned to the natural frequency or harmonic of the wire. A pump 64 feeds the spray heads from the water in the tank. Lastly, conventional mechanical means, such as a wiper 66, is used to remove the last of the smut from the wire. Other techniques may be used as well, including feeding the wire through wet sand, or by ultrasound. The wire then exits via two rear pulleys 68, which are also connected to the positive terminal of the power supply.

Following this step, the resulting product may then be passed to a further processing station, e.g. electroplating. Although the process described above involves continuously feeding the wire through the electrolysis bath, it could also be processed in successive sections, i.e. batch fed.

The following are several specific operating examples for the magnetite-removing process of the present invention, using the general process shown in FIG. 6 and described above. In one example, wire was bent under tension at 45° over ⅝-inch radius pulleys. The wire was then submerged in an electrolysis cell bath with a 40 grams per liter sodium chloride electrolysis solution. The pulsating DC current was applied to both ends of the wire. The cathode was formed by two vertical steel cathodes mounted parallel to the wire and located about ½ inch from the wire. In this arrangement, the anode was depassified and no chlorine or oxygen production was observed from the wire (anode). The pulsating DC signal from the power supply was approximately 7.8 volts, with a peak current of 9.8 amperes, at a frequency of 60 Hz, with a 50% duty cycle, producing an average anodic peak current density of 451 milliamps per square centimeter of wire surface area.

In the second example, the wire was initially bent in two planes under tension, initially at 45° over ⅝-inch radius pulleys, and then turned 90° and rebent at 45° over ⅝-inch pulleys. The wire was then submerged in an electrolysis cell bath with the electrolysis solution being 40 grams of sodium chloride per liter, at a temperature of 42° C. The pulsating DC current had an average peak of 7.2 volts, with a peak current of 38.5 amperes, at a frequency of 60 Hz, with a 13% duty cycle and an average anodic peak current density of 1784 milliamperes per square centimeter of wire surface area.

In a third example, a wire was bent first at a 45° angle over ⅝-inch radius pulleys, then turned 90° and rebent at a 45° angle over ⅝-inch pulleys. The wire was then submerged in an electrolysis cell bath with a 40 gram per liter sodium chloride electrolysis solution at a temperature of 45° C. The pulsating DC signal current had a peak voltage of 10.0 volts, with an average peak current of 55.0 amperes, at a frequency of 60 Hz, with a 19% duty cycle and an average anodic peak current density of 2548 milliamperes per square centimeters of wire surface.

In Example 4, the wire was bent in two planes, first at a 45° angle and then turned circumferentially 90° and rebent at a 45° angle over ⅝ inch pulleys. The wire was then submerged in an electrolysis cell bath with a 40 gram per liter sodium chloride electrolysis solution at a temperature of 45° C. The average peak voltage of the pulsating DC was 7.55 volts, with an average peak current of 36.7 amperes, at a frequency of 60 Hz, with a 13% duty cycle and an average anodic peak current density of 2156 milliamperes per square centimeter of wire surface area.

The above four examples were all successful in delaminating magnetite from steel substrate surfaces in the form of a wire. The time required varied from 30 seconds for example 1 to approximately 10 seconds in example 4. The remaining magnetite was removed by rinsing with water and washing. In each case, removal of the magnetite was verified by a scanning electron microscope.

Hence, a mechanical method for removing magnetite, and similar oxide films, from a metal substrate such as iron-containing steel, has been described.

Figure 8:
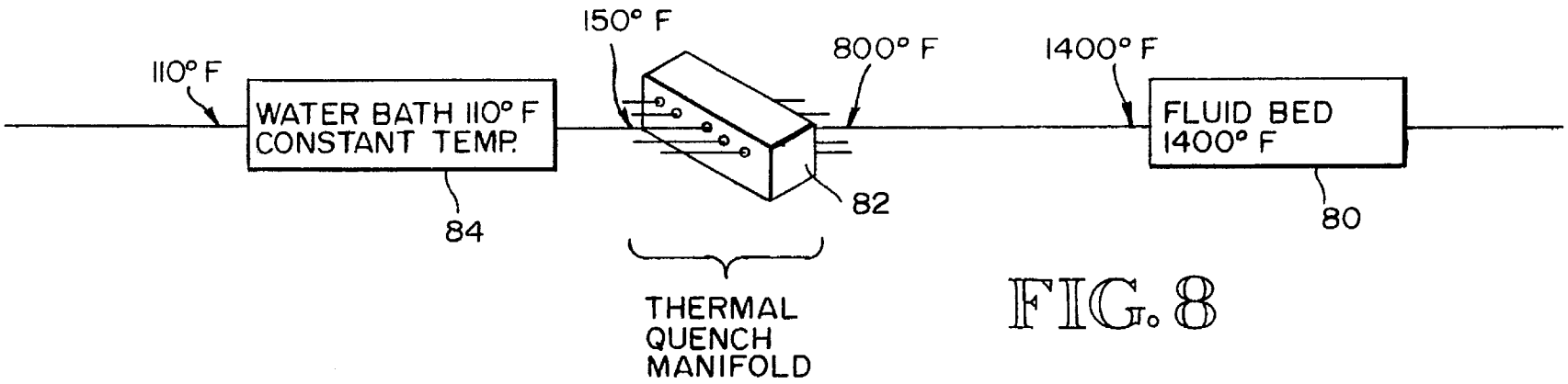
FIG. 8 is a diagram showing a thermal stressing step.

FIG. 8 shows a thermal process which can be used in combination with the mechanical stressing techniques described above or in some cases can be used by itself to facilitate convenient removal of magnetite or other oxide from the underlying metal wire. In the embodiment shown, an oxide-coated steel wire emerges from a fluid bed 80 where it has been annealed at a temperature of approximately 1400° F. Other metals will have different annealing temperatures. Also, other annealing techniques than a fluid bed may be used. Annealing, as is well known, is used to reduce strain from metal wire which occurs during extrusion. The annealing step is for illustration only, however, as it is not necessary for use of the present invention. When a steel wire emerges from the fluid bed or other annealing process at the specified high temperature and proceeds to cool in the air, it typically will go through a number of different crystalline stages. The change in crystalline structure during cooling will also be different for different metals.

The wire will usually reach a temperature of approximately 800° F. by the time the wire has moved 20 feet or so downstream (traveling at a typical rate of 215 feet/minute). At this point, the oxide surface film (typically magnetite) is rapidly cooled, i.e. quenched, such as by passing the coated wire through a manifold 82, in which cold water at relatively high pressure is applied against the oxide coated wire. If the oxide layer has a lower coefficient of thermal expansion relative to that of the metal wire underneath, then the rapid cooling will stress the magnetite so that small ruptures, perforations or punctures will occur therein, or alternatively the magnetite is slightly delaminated, i.e. buckled, swelled-up or lifted off from the underlying metal.

In either case, it is significantly easier to then thoroughly crack/rupture the thermally stressed magnetite film by the mechanical steps described above, or in some cases to remove it directly with the electrolysis bath without the addition of the mechanical stressing.

In the case of steel in particular, it is important that the thermal quenching occur after the wire has cooled down sufficiently and has hence gone through several successive crystalline stages so that the quenching does not produce martensite, which is an extremely brittle and undesirable steel crystalline structure. This can occur when quenching is carried out when the wire is still too hot. In addition, again for the example of steel, the carbon content of the wire is significant. Relatively low carbon content steel is preferable, as this reduces the potential for producing martensite. As indicated above, the temperature of a steel wire prior to quenching should be approximately 800° F. or less.

Following the step of thermal quenching, after the coated wire leaves the manifold or other quenching device, the wire is again air cooled for a short distance, approximately 12 feet, although this distance can be varied. When the wire leaves the quenching manifold 82, its temperature has typically been reduced to approximately 150° F. The temperature of the wire is then further slightly reduced in air, until the wire reaches water bath 84, which in the embodiment shown is approximately 4 feet long and at a temperature of 110° F. When the coated wire has passed through the water bath, it is at a temperature of approximately 110° F.

As indicated above, the wire can then be mechanically stressed as described in detail above, such as by bending, or in some cases, the mechanical stressing step can be bypassed, and the wire can be moved directly to the electrolysis bath. When the mechanical stressing is used, it need not be with as much force or with as severe bending as otherwise.

A thermal stressing step may also be accomplished when the oxide-covered wire is already at room temperature. In this case, the steel wire element is heated to approximately 800° F. in order to establish a temperature gradient and resulting stress gradient between the oxide film and the underlying metal, i.e. the oxide is at a higher temperature than the wire. This results in the surface oxide being put into expansion while the underlying wire material remains in compression. This thermal stressing step can then be followed by a gradual reduction of the temperature, or if desired, by a quenching step, as described above, to provide a cycle of thermal stress, producing increased stress on the oxide film. The wire can then be mechanically stressed, as noted above, or in some cases may be moved directly to the electrolysis bath.

It should be understood, however, that the specific parameters provided above for the step of thermal stressing are for steel wire and will be different for other metals.

Although a preferred embodiment has been disclosed, it should be understood that various modifications and substitutions may be made in the embodiment as disclosed within the ordinary skill in the art. The invention is defined by the claims which follow:

We claim:

1. A method for removing oxide films from a metal member, comprising the steps of:

applying thermal stress to an oxide film-covered metal member in such a manner as to establish a temperature gradient between the oxide film and the metal member;

applying stress to the metal member so as to rupture the oxide film thereon approximately to the surface of the metal member;

moving the metal member through an electrolysis cell bath having two spaced electrodes, wherein the metal member forms one electrode in the electrolysis cell bath; and applying a pulsating DC signal to the one electrode and to the other electrode in the electrolysis cell bath, wherein the oxide on the metal member is sufficiently ruptured that the pulsating DC signal flows through the rupture areas to the metal member, maintaining the metal member electrode in a state of depassivation such that no oxygen is produced therefrom, and loosening the oxide film from the metal member, so that the oxide film can be readily removed from the metal member.

2. A method of claim 1, wherein the oxide film is magnetite, and the metal member is made from iron-containing steel.

3. A method of claim 1, wherein the metal member is an elongated wire, and wherein the pulsating DC current is applied to spaced-apart portions of the wire which extends through the electrolysis cell bath.

4. A method of claim 3, wherein the pulsating DC current is applied to the wire by spaced-apart pulleys.

5. A method of claim 1, wherein the metal member forms the anode in the electrolysis cell bath.

6. A method of claim 1, wherein the electrolysis cell bath includes an electrolysis solution of sodium chloride and water.

7. A method of claim 1, including the step of removing any remaining oxide film from the metal member, leaving a clean surface on the metal member.

8. A method of claim 7, wherein the remaining oxide is removed by rinsing the wire with water after the wire emerges from the electrolysis cell bath.

9. A method of claim 1, wherein the metal member is moved continuously through the electrolysis cell bath.

10. A method of claim 1, wherein successive portions of the metal member are moved into and then out of the electrolysis bath.

11. A method of claim 1, including the step of removing any remaining oxide film from the metal member by the application of abrasive particles thereto.

12. A method of claim 1, wherein the step of applying stress to the metal member includes the step of bending the metal member.

13. A method of claim 1, including the step of removing any remaining oxide film from the metal member by application of ultrasound thereto.

14. A method of claim 1, wherein the step of applying stress to the metal member includes the step of ultrasonic vibration of the metal member.

15. A method of claim 1, wherein the step of applying thermal stress includes the step of cooling the oxide film-covered metal member from an elevated temperature.

16. A method of claim 15, wherein the elevated temperature is approximately no greater than 800° F.

17. A method of claim 1, wherein the step of applying thermal stress includes the step of heating the oxide film-covered metal member to an elevated temperature, thereby establishing a substantial temperature gradient between the oxide film and the metal member.

18. A method of claim 17, wherein the elevated temperature is approximately 800° F.

19. A method of claim 17, wherein the step of applying thermal stress includes the further step of cooling the oxide film from the elevated temperature, thereby reversing the temperature gradient.

20. A method for removing oxide films from a metal member comprising the steps of:

applying thermal stress to an oxide film-covered metal member, thereby establishing a temperature gradient between the oxide film and the metal member so as to disrupt the physical relationship between the oxide film and the metal member;

moving the metal member through an electrolysis cell bath having two-spaced electrodes, wherein the metal member forms one electrode in the electrolysis bath; and applying a pulsating DC signal to the one electrode and to the other electrode in the electrolysis cell bath, when the oxide on the metal member is sufficiently disrupted that the pulsating DC signal flows to the metal member, maintaining the metal member electrode in a state of depassivation such that no oxygen is produced therefrom, and loosening the oxide film from the metal member so that the oxide member can be readily removed from the metal member.

21. A method of claim 20, wherein the metal member is an elongated wire, and wherein the pulsating DC current is applied to spaced-apart portions of the wire which extends through the electrolysis cell bath.

22. A method of claim 20, including the step of removing any remaining oxide film from the metal member, leaving a clean surface on the metal member.

23. A method of claim 22, wherein the remaining oxide is removed by rinsing the wire with water after the wire emerges from the electrolysis cell bath.

24. A method of claim 22, wherein the remaining oxide is removed by application of ultrasound thereto.

25. A method of claim 22, wherein the remaining oxide is removed by application of abrasive particles thereto.

26. A method of claim 20, wherein the step of applying thermal stress includes the step of cooling the oxide film-covered wire from an elevated temperature, resulting in said temperature gradient.

27. A method of claim 26, wherein the elevated temperature is less than approximately 800° F.

28. A method of claim 20, wherein the step of applying thermal stress includes the step of elevating the oxide film-covered layer from an ambient temperature to a temperature of approximately 800° F. resulting in said temperature gradient.

29. A method of claim 28, including the further step of cooling the heated wire so as to produce a cycle of temperature gradient between the oxide film and the metal member.

* * * * *